US005084927A

United States Patent [19]

Parkevich

[11] Patent Number: 5,084,927

[45] Date of Patent: Feb. 4, 1992

[54] METHOD FOR PROTECTING A SURFACE FROM CONTAMINANTS

[75] Inventor: Gayle Parkevich, Cutler, Ind.

[73] Assignee: Tan Sense Medical Corp., Cutler, Ind.

[21] Appl. No.: 653,664

[22] Filed: Feb. 8, 1991

[51] Int. Cl.[5] ..... A61G 1/01; A61G 13/00; A47G 9/02

[52] U.S. Cl. ..... 5/484; 51/487; 51/488

[58] Field of Search ..... 5/488, 484, 482, 487, 5/473, 470, 471; 378/209; 269/322

[56] References Cited

U.S. PATENT DOCUMENTS

| | | | |
|---|---|---|---|
| 1,591,014 | 7/1926 | Campbell | 4/243 |
| 1,891,629 | 12/1932 | Van Wagner | 5/488 |
| 1,967,422 | 7/1934 | Nadelson . | |
| 2,160,100 | 5/1939 | Crawford | 4/245 |
| 3,348,243 | 10/1967 | Kelly | 4/245 |
| 3,761,973 | 10/1973 | Leventhal . | |
| 3,763,907 | 10/1973 | Hockley et al. | 2/69.5 |
| 3,851,341 | 12/1974 | Aoyama | 4/243 |
| 4,025,973 | 5/1977 | Walbrecht | 5/488 |
| 4,118,438 | 10/1978 | Matsui et al. | 260/857 L |
| 4,136,072 | 1/1979 | Ladish et al. | 260/27 R |
| 4,337,188 | 6/1982 | Climenhage et al. | 524/140 |
| 4,358,865 | 11/1982 | Pagel et al. | 5/488 |
| 4,359,787 | 11/1982 | Shoji | 4/245 |
| 4,367,256 | 1/1983 | Biel | 428/218 |
| 4,399,180 | 8/1983 | Briggs et al. | 428/212 |
| 4,425,268 | 1/1984 | Cooper | 524/110 |
| 4,436,788 | 3/1984 | Cooper | 428/484 |
| 4,504,434 | 3/1985 | Cooper | 264/22 |
| 4,508,775 | 4/1985 | Adiletta | 5/484 |
| 4,664,866 | 5/1987 | van der Heijden | 264/519 |
| 4,676,376 | 6/1987 | Keiswetter | 206/494 |
| 4,766,617 | 8/1988 | Thygesen et al. | 4/243 |
| 4,833,017 | 5/1989 | Benoit | 428/519 |
| 4,884,839 | 12/1989 | Keiswetter | 297/219 |
| 4,885,352 | 12/1989 | Erickson | 524/585 |
| 4,910,819 | 3/1990 | Brown | 5/484 |
| 4,991,242 | 2/1991 | Brown | 5/484 |
| 4,993,091 | 2/1991 | Draper et al. | 5/508 |
| 4,993,092 | 2/1991 | Weeks | 5/484 |
| 5,007,123 | 4/1991 | Salyards | 5/470 |

FOREIGN PATENT DOCUMENTS

| | | | |
|---|---|---|---|
| 0667196 | 9/1988 | Switzerland | 5/470 |

*Primary Examiner*—Alexander Grosz
*Attorney, Agent, or Firm*—Barnes & Thornburg

[57] ABSTRACT

According to the present invention, a method is provided for protecting a surface from contamination. The method includes the steps of providing a film sheet having a maximum pore size of less than 0.1 micron and covering the surface with the film sheet. After each use, the portion of the film sheet covering the surface is discarded.

3 Claims, 1 Drawing Sheet

METHOD FOR PROTECTING A SURFACE FROM CONTAMINANTS

BACKGROUND AND SUMMARY OF THE INVENTION

The present invention relates to a method for protecting a surface from contamination. More particularly, the present invention provides a barrier to reduce the likelihood that contaminants having a size greater than a predetermined size will pass through the barrier and contact the surface.

Various methods and devices are known for covering a support surface such as medical examining tables or the like. Paper is a material commonly used to cover examining tables. It is known to provide paper dispensers for holding a roll of paper and to unroll a fresh portion of the paper onto an examining table prior to each use. Examples of paper roll dispensers are illustrated in U.S. Pat. No. 1,891,629 and U.S. Pat. No. 1,967,422. Paper covering material does not prevent liquids such as body fluids from passing through the paper to the support surface.

Other materials are known for covering support surfaces such as mattresses or examining tables. Absorbent pads having a plastic backing are known for covering mattresses and support surfaces. Examples of these plastic-backed covering materials are disclosed in U.S. Pat. No. 3,761,973 and U.S. Pat. No. 4,358,865. While these plastic-backed materials may be somewhat liquid impermeable, conventional surface protection methods do not address the problem of preventing infectious agents or other contaminants from passing through the covering material to the support surface.

In recent years, concerns about contamination of medical instruments and facilities have increased. This is due in large part to the growing awareness of diseases which can be transmitted through exchange of bodily fluids. X-ray tables and medical examining tables are places where bodily fluids are likely to escape from a patient supported on the table. Unless precautions are taken, the next patient supported on the table could be exposed to these bodily fluids. The present invention is designed to reduce the likelihood that infectious agents, contaminants, or other bodily fluids will pass from a patient resting on the support surface to the surface, thereby contaminating the surface.

According to the present invention, a method is provided for protecting a surface from contamination. The method includes the steps of providing a film sheet having a maximum pore size of less than 0.1 micron and covering the surface with the film sheet. After each use, the portion of the film sheet covering the surface is discarded.

According to one aspect of the present invention, the film sheet is provided for covering a surface such as a medical examining table or X-ray table to reduce the likelihood that liquids or bodily fluids will pass through the film sheet to the surface. The film sheet has a maximum pore size of less than 0.1 micron. Therefore, the film sheet advantageously reduces the likelihood that substances having a size greater than 0.1 micron will pass through the film sheet to the surface.

According to another aspect of the present invention, the film sheet has a tackiness or "cling" property on a first side of the sheet facing the surface so that the film sheet clings to the surface. The film sheet does not have a tackiness or cling property on a second side of the sheet facing away from the surface so that the film sheet does not stick to a user lying on the film sheet. In other words, the film sheet is advantageously a one-sided cling sheet having a first cling side and a second non-cling side.

Illustratively, the surface protected by the present invention can include an X-ray table, medical examining table, dentist's chair, or veterinary examination table. In addition, the film sheet could be used to wrap bodies, body parts, or organs. Other potential uses for the film sheet having a maximum pore size of less than 0.1 micron include liners for trash receptacles in hospitals, podiatrist's equipment, gloves, condoms, toilet seat covers, liners for clothing, combs and brush pockets for beauty shops, liners for surgical boots or masks, wraps for surgical instruments, oxygen tents, or sanitary napkin disposal packages.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
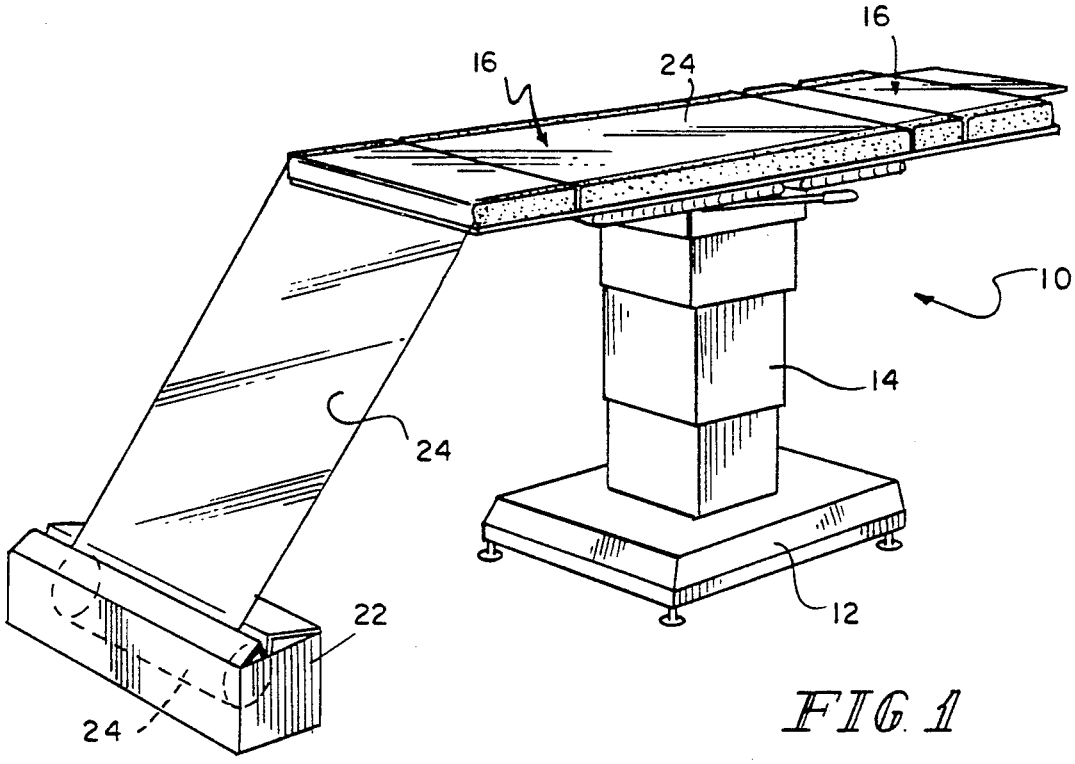
FIG. 1 is a perspective view of a preferred embodiment of the present invention illustrating a dispenser positioned at a first end of the surface to be covered and a film sheet for covering the surface.

Referring now to the drawings, a conventional medical examining table 10 includes a base 12, a support pedestal 14, and a support surface 16 for supporting a patient lying on the table during the medical examination or X-ray. During an examination, body fluids can escape from the patient and collect on the support surface 16. Even if the support surface 16 is cleaned between uses, a subsequent user could be exposed to some of the body fluids which might remain on surface 16 from the previous user. Therefore, support surface 16 can provide an environment for the spread of transmittable diseases from one user or patient to another. Because of this potential health risk, it is necessary to take precautions to reduce the likelihood that bodily fluids will pass from a patient resting on the support surface 16 to the support surface 16.

In order to reduce the likelihood of contamination of support surface 16, a dispenser 22 is provided for dispensing a film sheet 24 to cover support surface 16. Prior to each use, the surface 16 can be covered with an unused portion of the film sheet 24 to provide a clean, sanitary cover 24 for surface 16 for supporting the patient. The film sheet 24 of the present invention has a maximum pore size of less than 0.1 micron. The film sheet 24 has a cling property on a first side of the film sheet 24 facing support surface 16 so that the film sheet 24 clings to the surface 16. A second, opposite side of the film sheet 24 facing away from support surface 16 does not have a cling property. Therefore, film sheet 24 does not stick or cling to a patient lying on the film sheet 24. After each use, the used portion of film sheet 24 is discarded.

Figure 2:
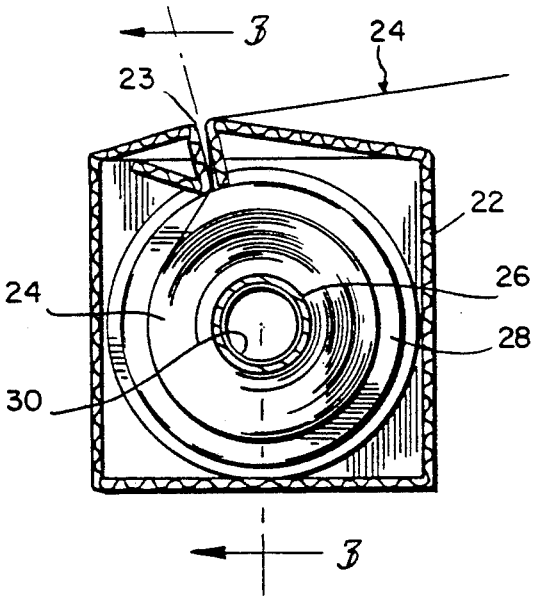
FIG. 2 is a transverse sectional view of the dispenser shown in FIG. 2.

FIG. 2 illustrates a sectional view of the dispenser 22 of the present invention. The film sheet 24 is preferably wound around a cylinder or tube 26 to form a roll for easy storage and dispensing capability. The tube 26 is situated inside dispenser 22. A loose end of film sheet 24 passes through an aperture 23 formed in dispenser 22.

Figure 3:
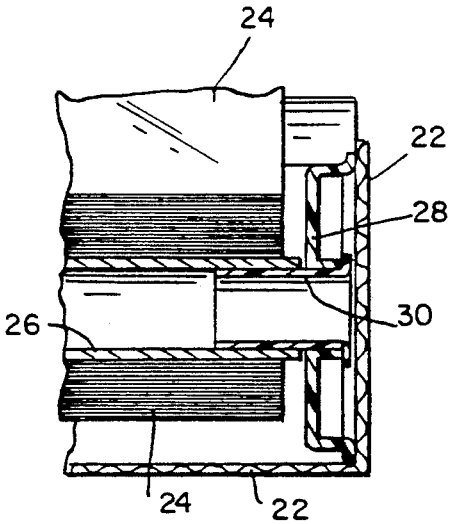
FIG. 3 is a portional sectional view taken along lines 3—3 of FIG. 2 illustrating an end portion of the dispenser.

As best illustrated in FIG. 3, dispenser 22 includes an end cap 28 having a central member or finger 30 which extends inside tube 26 to permit rotation of tube 26 inside dispenser 22. By pulling on the loose end of the film sheet 24, the film sheet 24 can easily unroll so that the support surface 16 can be covered with a section of the film sheet 24. Various widths for film sheet 24 are available to cover various sizes of support surfaces 16. It is understood that various other dispensers could be used to hold the unused portion of the film sheet 24 without departing from the scope of the invention.

The film sheet 24 of the present invention is illustratively a three layer film sheet model number TSMED available from Linear Films, Inc. of Tulsa, Oklahoma. The first layer is a non-cling layer, the middle layer is the core layer, and the third layer is the cling layer. The film sheet 24 has a thickness of about 0.6 mil (60 gauge film).

The film sheet 24 used in accordance with the present invention should be tested to determine the pore size of the film sheet 24 prior to using a particular film sheet on the surface 16. The pore size distribution analysis was conducted using a Coulter® Porometer II. Tests can be performed by Scientific Instruments Application Laboratory, located in Hialeah, Florida. It is important that the film sheet 24 has a maximum pore size of less than 0.1 micron in order to reduce the likelihood of most contaminants passing therethrough.

The Coulter® Porometer testing uses a liquid displacement technique to measure the pore size distribution of a sample of material. The sample is first thoroughly wetted with liquid of low surface tension and low vapor pressure. An example of this liquid is Coulter® Porofil liquid. By thoroughly wetting the sample, all of the pores of the sample are filled with the liquid. The wetted sample is then subjected to increasing pressure applied by a gas source. As the pressure of the gas increases, it reaches a point to overcome the surface tension of the liquid in the largest pores and pushes the liquid out of the large pores of the sample. Increasing the pressure further allows gas to flow out from the smaller pores until all the pores have been emptied. By monitoring the pressure of gas applied to the sample and the flow of gas through the sample when liquid is expelled, a "wet" run is obtained for the sample. The basic equation used in the calculation of the pore diameter is as follows:

$$\text{Pore Diameter (Microns)} = \frac{40\ T\ (\text{mN/m})}{\text{pressure (mbar)}}$$

where T = surface tension of liquid

Film sheets other than the TSMED film sheet 24 available from Linear Films, Inc. can be used in accordance with the present invention provided, however, that such film sheets have a maximum pore size of less than 0.1 micron.

The maximum pore size of the TSMED film sheet available from Linear Films, Inc. is about 0.066 micron and the minimum pore size is about 0.052 micron. The mean pore size is about 0.060 micron. As discussed above, the maximum pore size of film sheet 24 must be less than 0.1 micron in order to reduce the likelihood that infectious agents, contaminants, or other body fluids will pass from the patient resting on surface 16 to the surface 16. The fluids collect on the film sheet 24. After the patient moves, the used film sheet 24 is removed from surface 16 and discarded.

Although the invention has been described in detail with reference to a certain preferred embodiment, variations and modifications exist within the scope and spirit of the invention as described and defined in the following claims.

What is claimed is:

1. A method for protecting a surface, adapted to support a patient, from contamination, the method comprising the steps of: providing a disposable, single, and generally planar film sheet having an upper side, a lower side and side edges, said film sheet having a maximum pore size of less than 0.1 micron, at least the lower side of the film sheet facing the surfaces having a cling property so that the film sheet clings to the surface, covering the surface with said film sheet, to thereby reduce the likelihood of contaminating the surface with infectious agents, contaminants, bodily fluids or the like, and discarding said film sheet prior to supporting a new patient on said surface.

2. The method of claim 1, wherein the film sheet has a thickness of about 0.6 mil.

3. The method of claim 1, wherein the maximum pore size of the film sheet is about 0.066 micron.

* * * * *